US005607150A

United States Patent [19]

Schnorr, III

[11] Patent Number: 5,607,150

[45] Date of Patent: Mar. 4, 1997

[54] PORTABLE BATTER'S BOX

[76] Inventor: George Schnorr, III, 4920 Parete Cir., Jacksonville, Fla. 32218

[21] Appl. No.: 565,983

[22] Filed: Dec. 1, 1995

[51] Int. Cl.[6] ..... A63B 71/02

[52] U.S. Cl. ..... 473/499

[58] Field of Search ..... 273/25, 26 R, 273/31, 411

[56] References Cited

U.S. PATENT DOCUMENTS

| | | | |
|---|---|---|---|
| 1,897,801 | 2/1933 | Healy | 273/31 |
| 3,768,809 | 10/1973 | Ciarfello . | |
| 3,815,906 | 6/1974 | Hermo | 273/26 R |
| 3,889,379 | 6/1975 | Cline | 33/174 G |
| 3,979,116 | 9/1976 | Matchick | 273/26 R |
| 4,194,735 | 3/1980 | Wilson | 273/26 R |
| 4,510,692 | 4/1985 | Overhosler et al. | 33/174 G |
| 4,516,772 | 5/1985 | Stratton | 273/26 R |
| 4,552,120 | 11/1985 | Nall et al. | 124/1 |
| 4,786,053 | 11/1988 | Barnes, Jr. | 273/26 R X |
| 4,810,560 | 3/1989 | Sell | 428/192 |
| 4,932,656 | 6/1990 | Pierce | 273/26 R |
| 5,076,580 | 12/1991 | Lang | 273/26 R |
| 5,371,949 | 12/1994 | Delaurier | 33/1 G |

*Primary Examiner*—William H. Grieb

*Attorney, Agent, or Firm*—Brian S. Steinberger; Law Offices of Brian S. Steinberger

[57] ABSTRACT

Ground engageable flexible batters boxes that abut and remain flush to the ground. A first version of the flexible batters box includes straps and flaps formed plastic, nylon or the like, with optional pegs/prongs on at least each of the four corners for allowing the box to remain flush to the ground. Extension side flaps allow the box to be positioned next to home plate and can also include pegs/prongs. The rectangular taped device is foldable and rollable along with the pegs/prongs for insertion into a storage pouch bag for travel. Another version includes PVC pipes that interconnect into one another. The PVC pipes can be approximately ½ inch to 2 inches in diameter. Users dig out curved indentations in the ground beneath the PVC pipes so that a most of the PVC pipes is buried below ground leaving a small visible portion above ground. Specific dimensional sizes of the boxes can be used for Major League, Little League and Softball League requirements. The boxes can be used for practice and for actual play.

15 Claims, 5 Drawing Sheets

PORTABLE BATTER'S BOX

This invention relates to a batters box, and in particular to a potable foldable device formed from flaps and straps of plastic, nylon and the like with ground engaging prongs, The invention helps batters practice their swings. Alternatively, PVC pipes insertable within one another form another box, wherein lower sides of the pipes can be buried in the ground.

BACKGROUND AND PRIOR ART

Children learning how to play and practice baseball and softball often have difficulty determining where to position their feet in relation to home plate when approaching homeplate for batting. The problem becomes more difficult since major league, baseball, little league baseball and softball each have different regulations for defining the batting area around homeplate. Teenagers and adults face similar hurdles when practicing and playing these games. Currently, unless the batting area has been line marked by white chalk, practitioners must use guess-work to establish the correct location area. This becomes a particular problem when one is trying to practice and play on an unmarked field such as a backyard or park.

U.S. Pat. No. 3,768,809 to Ciarfello describes a portable device for delineating playing fields made of a plastic material. However, this device is limited to the games of tic tac toe and hopscotch. U.S. Pat. No. 3,889,379 to Cline describes a device for writing a baseball batters' box that includes a raised template frame. Cline uses this device to create a ground type imprint so that a scribe or a line striping machine can establish the batters box, column 4, lines 13–24. If the Cline device remained on the ground, the raised edges of the device can create a dangerous tripping hazard to those wanting to take batting practice. U.S. Pat. No. 4,810,560 describes a batting box make of a mat material. However, this device is no more than a mat that the batter must stand on directly. Other types of devices of related interest include U.S. Pat. Nos. 3,815,906 to Hermo; 3,979,116 to Matchick; 4,194,735 to Wilson; 4,510,692 to Overholser et al.; 4,516,772 to Stratton; 4,552,120 to Nail et al.; 4,932,656 to Pierce; 5,076,580 to Lang; and 5,371,949 to Delaurier, which describe similar unsuccessful attempts to solve the problems mentioned above.

SUMMARY OF THE INVENTION

The first objective of the present invention is to provide a portable and foldable batters box for major league baseball practice and use.

The second object of this invention is to provide a portable and foldable batters box for little league baseball practice and use.

The third object of this invention is to provide a portable and foldable batters box for softball practice and use.

The fourth object of this invention is to provide a portable and foldable batters box that mounts flush to the ground in use.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description .and not of limitation.

FIRST PREFERRED EMBODIMENT

Figure 1A:
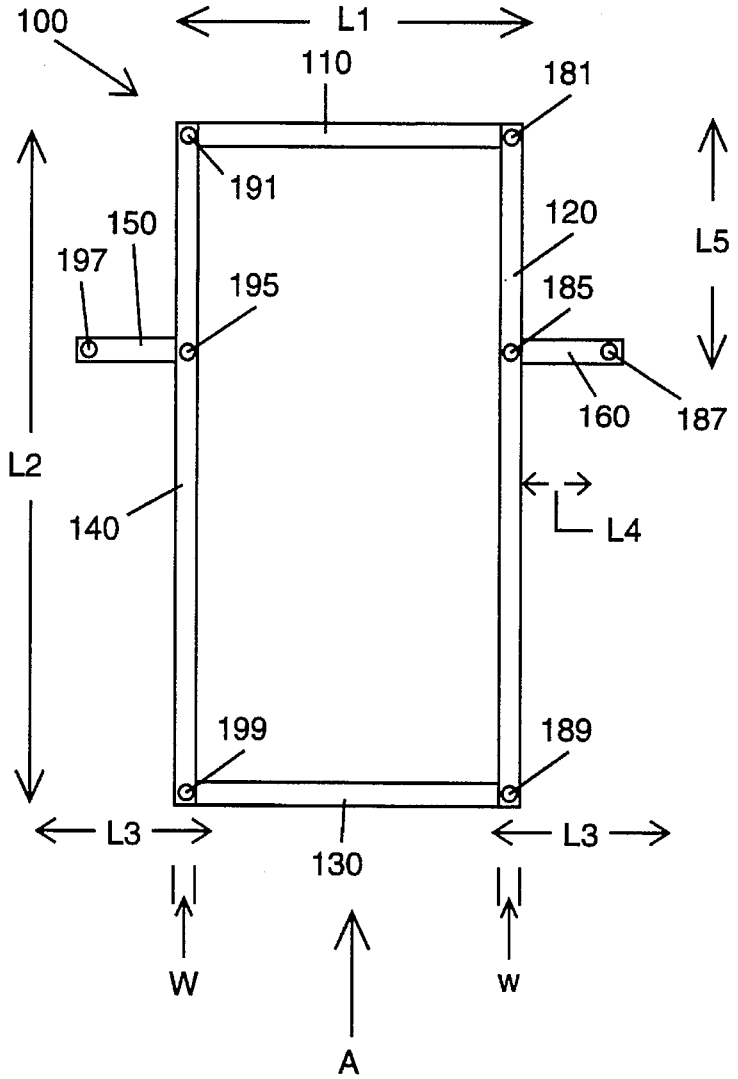
FIG. 1A is a top view of a first preferred embodiment of the batters box invention.
Figure 1B:
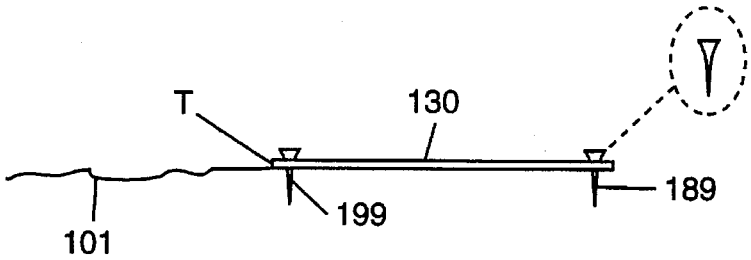
FIG. 1B is a side view of the first preferred embodiment of FIG. 1A along arrow A.
Figure 1C:
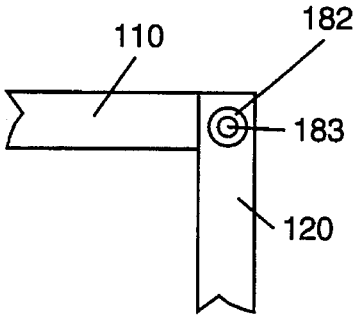
FIG. 1C is an enlarged view of a corner of the batters box of FIG. 1A without a peg/prong.

FIG. 1A is a top view of a first preferred embodiment 100 of the batters box invention. FIG. 1B is aside view of the first preferred embodiment 100 of FIG. 1A along arrow A. FIG. 1C is an enlarged view of a corner of the batters box of FIG. 1A without a peg/prong. Referring to FIGS. 1A–1C, batters box 100 includes a top strap portion 110, right strap portion 120, lower strap portion 130 and left strap portion 140 connected at respective comers and mounted through the ground by pegs/prongs 181, 185, 187, 189, 191, 195, 197 and 199. The pegs and prongs 181, 185, 187, 189, 191, 195, 197 and 199 can be golfclub tees such as but not limited to one inch, two inch wooden, plastic tees and the like. Alternatively, the pegs/prongs can be nails such as but not limited to 3 penny and 12 penny galvanized nails and the like. The pegs/prongs enable the batters box 100 itself to be substantially flush against and abut to a ground surface 101. Each peg/prong has a respective spike portion to be inserted through metal grommets at each connection point between the strap portions. As shown in FIG. 1C, grommet 182 is ring shaped and is used to connect strap 110 to strap 120 and includes a through-hole therethrough for allowing a peg/prong such as 189 to mounted therein.

Referring to FIGS. 1A–1B, batters box 100 includes a first side flap 160 perpendicular to and connected at 185 to an upper midportion location of long strap 120. Connection point 185 can include a grommet and peg/prong such as the ones described previously. Batters box 100 further includes a second side flap 150 perpendicular to and connected at 195 to an upper midportion location of long strap 140. Connection point 195 can also include a grommet and peg/prong such as the ones described previously. Flat straps and flaps 110, 120, 130, 140, 150 and 160 can be formed from flexible materials such as molded rubber, plastic, vinyl, nylon, burlap and the like. For example, a rubber strap/flap can have a thickness, T, of approximately 1/16 to approximately one inch, and a width, W, of approximately 2 to 4 inches. The respective grommets can allow the connecting flaps and straps to slidably rotate to one another so that the entire batters box 100 can be rolled and folded into a small space such as the pouch bag 400 which will be described in greater detail in reference to FIG. 4A. Alternatively, each connection point between flaps and straps can be molded to one another, where the grommet is only used to protect the through hole for pegs/prongs to be inserted therein.

Figure 2:
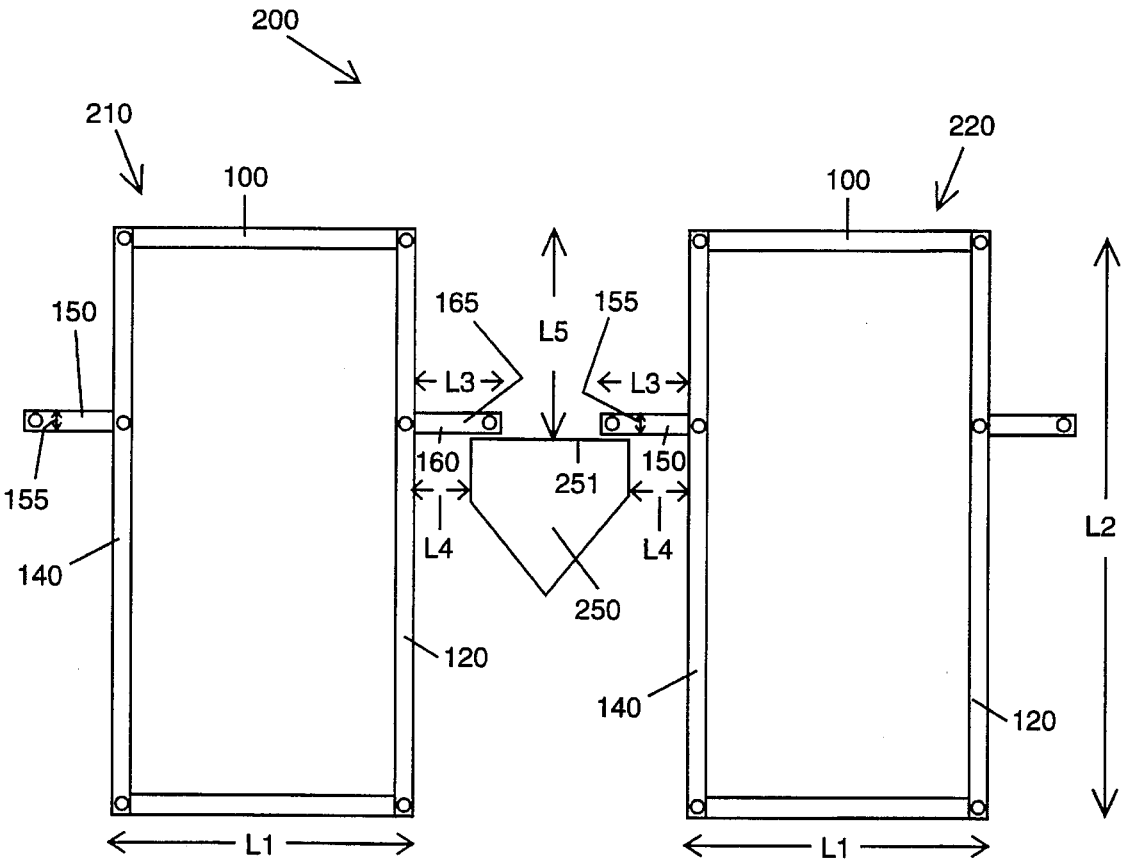
FIG. 2 is a top view of the first preferred embodiment used for right handed batters and left handed batters at homeplate.

The overall dimensions of the batters box 100 of FIGS. 1A–1C can include specific dimensions and positions when used for major league, little league and softball play as defined by TABLE I. Referring to FIG. 2, the relative position of batters box 100 can be positioned to the left side of homeplate 250 for right handed batters as shown by 210. Likewise the position of batters box 100 can be positioned to the right side of homeplate 250 for left handed batters as shown by 220. A lined visible colored marking 155 and 165 can be drawn on the respective side flaps 150 and 160 (i.e. a white strap against a black background, blue background). In operation the flap portion of flap 150 to the left of marking 155 can abut on the top edge 251 of homeplate 250 for left handed batters. Likewise the flap portion of flap 160 to the right of marking 165 can abut on the top edge 251 of homeplate 250 for right handed batters.

TABLE I

| Dimensions | Major League | Little League | Softball |
|---|---|---|---|
| L1 | 48" | 36" | 36" |
| L2 | 72" | 72" | 72" |
| L3 | 12" | 10" | 12" |
| L4 | 6" | 4" | 6" |
| L5 | 27.5" | 27.5" | 39.5" |

SECOND PREFERRED EMBODIMENT

Figure 3A:
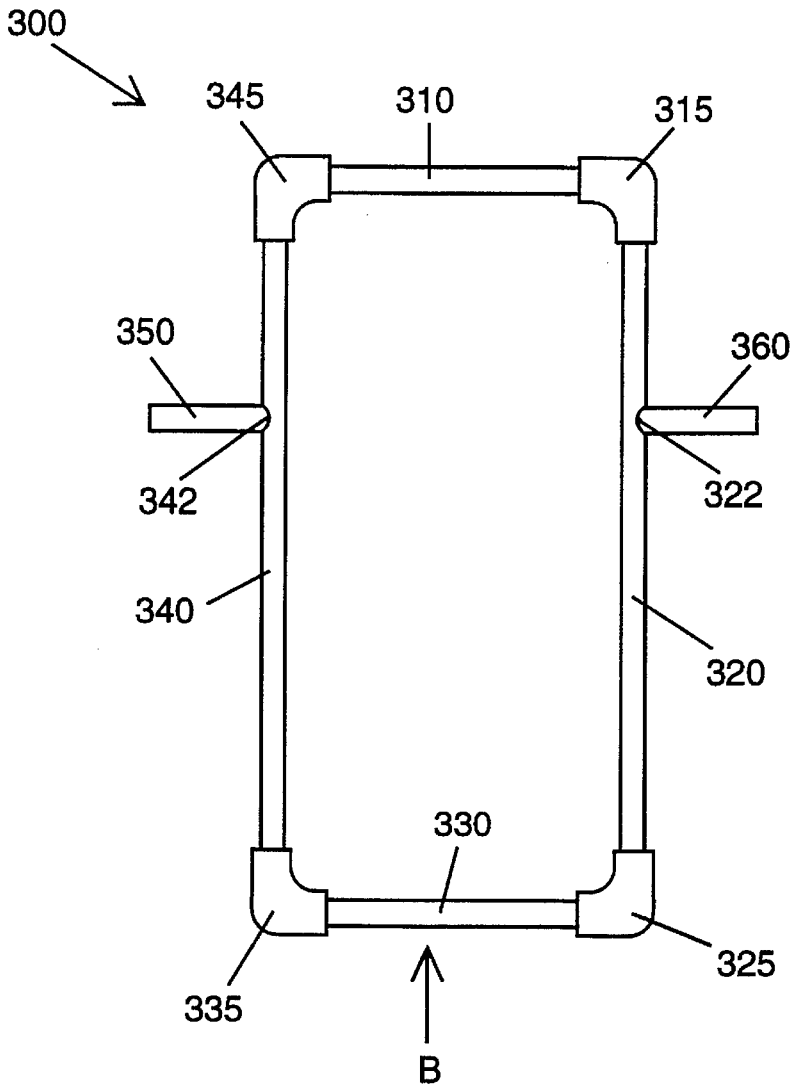
FIG. 3A is a top view of a second preferred embodiment of the batters box invention.

FIG. 3A is a top view of a second preferred embodiment 300 of the batters box invention.

Figure 3B:
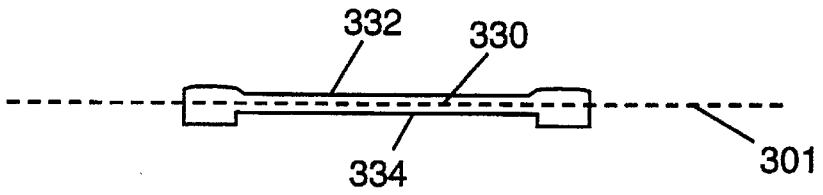
FIG. 3B is a side view of the second preferred embodiment of FIG. 3A along arrow B.

FIG. 3B is a side view of the second preferred embodiment 300 of FIG. 3A along arrow B. Embodiment 300 includes PVC pipes 310, 320, 330, 340 connected in a rectangular pattern to one another by being inserted into the open ends of ninety degree bend couplers 315, 325, 335 and 345. Small side pipe stems 350 and 360 are inserted into side holes 322, 342 of respective pipes 320 and 340. Each PVC pipe can have an exterior diameter of approximately ½ inch to 2 inches. The remaining dimensions of batters box 300 can follow TABLE I described above. In operation, the lower cylindrical halves of the PVC pipes can be buried in the ground wherein at least a portion of the upper sides 332 of the PVC pipes are exposed above ground surface 301 and at least half of the lower sides 334 of the cylindrical PVC pipes are buried below ground level 301. The embodiment 300 can be disassembled by pulling the pipes from their respective bend couplers, and pulling the side pipe stems out from their mount holes and bundling all the pipes together.

Figure 4A:
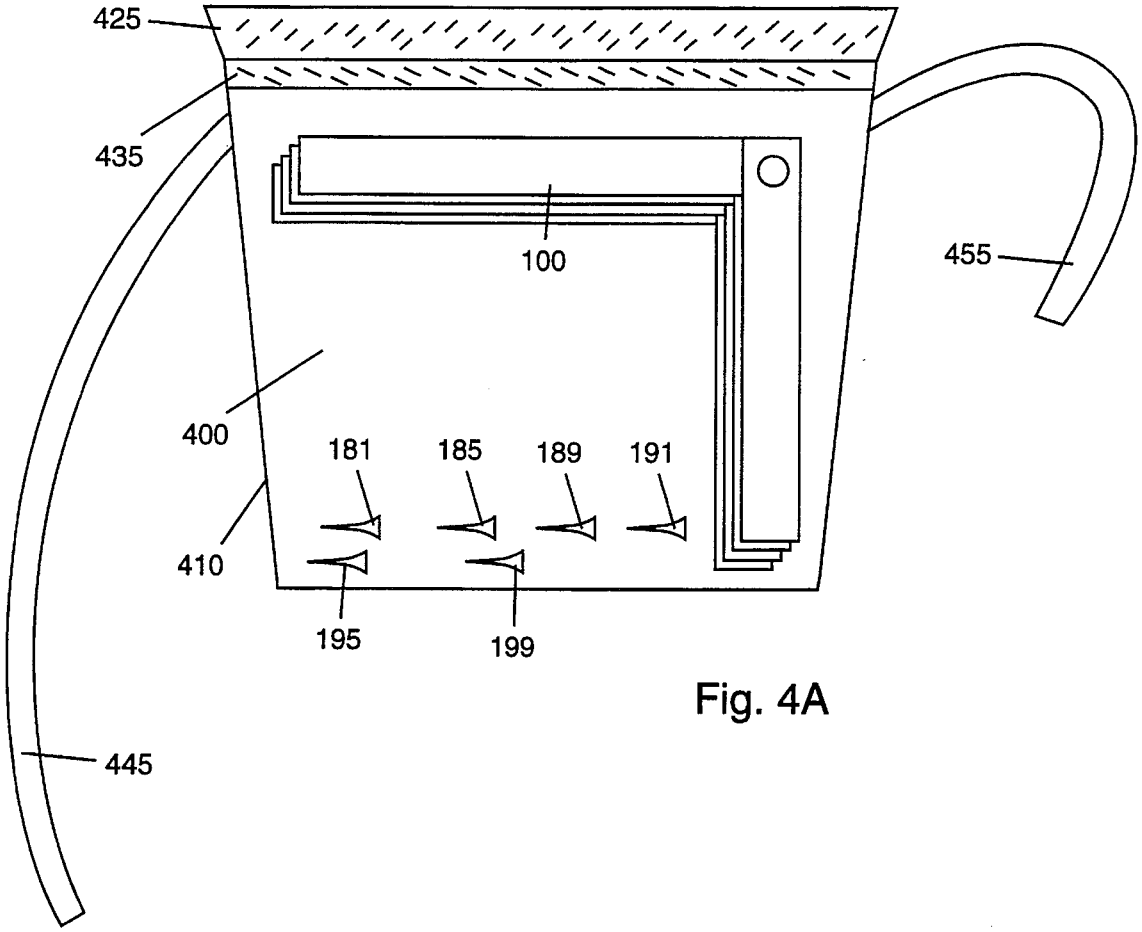
FIG. 4A is a side view of the first preferred embodiment of FIG. 1A–1B in a folded and disassembled position within a pouch storage bag.
Figure 4B:
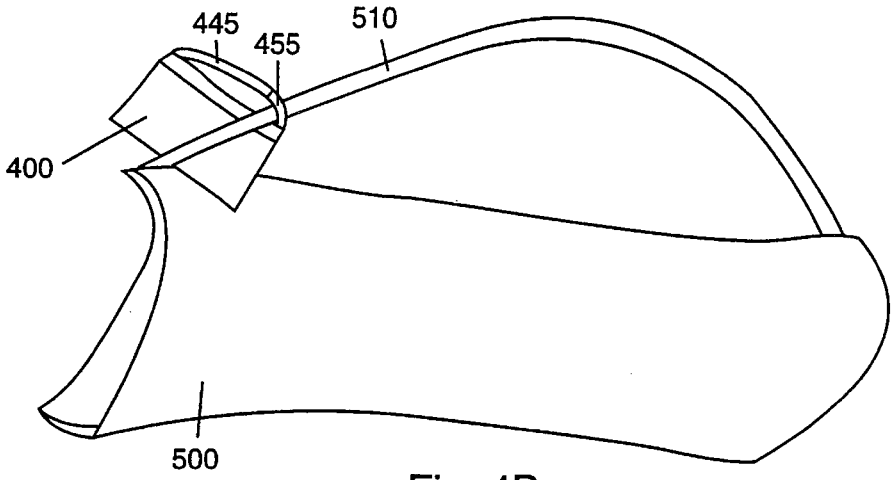
FIG. 4B is a perspective view of the filled pouch storage bag of FIG. 4A attached to a duffel bag.

FIG. 4A is a side view of the first preferred embodiment 100' of FIGS. 1A–1B in a folded and disassembled position 100' along with the pegs 181, 185, 189, 191, 195, 199 within a pouch storage bag 400. Storage bag 400 includes a plastic see-through bag portion that can be sized approximately seven inches by ten inches, along with hook and loop fasteners 425, 435 at a top portion such as Velcro®, or a zippers, or snaps or the like. Bag 400 further includes flexible plastic tie straps 445, 445 that also can include hook and loop fasteners which can attach the bag the shoulder straps 510 of a duffel bag 500 shown in FIG. 4B the latter of which is generally used to store bats and balls used in baseball and softball.

THIRD PREFERRED EMBODIMENT

Figure 5:
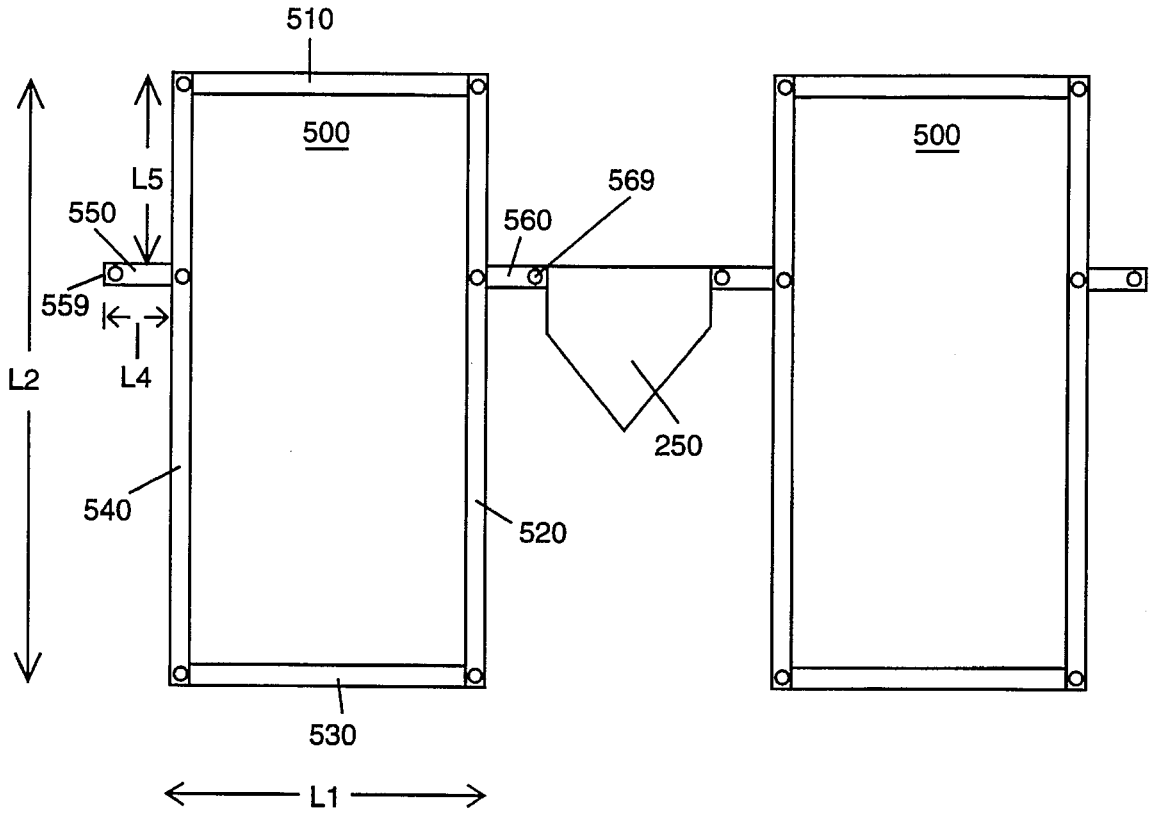
FIG. 5 is a top view of a third preferred embodiment of a battersbox used for right handed batters and left handed batters at homeplate.

FIG. 5 is a top view of a third preferred embodiment 500 of a battersbox used for right handed batters and left handed batters at homeplate 250. This embodiment is similar to the first embodiment 100 of FIGS. 1–2, where the dimensions of components 510, 520, 530 and 540 correspond to like components 110, 120, 130, 140 and 150 of FIGS. 1–2. Embodiment 500 of FIG. 5 has side flaps 550 and 560 each having a length, L4, and located a distance of L5 from the top 510 of the box 500. Side flaps 550 and 560 each have a side edge 559 and 569 abutting against the sidewalls of homeplate 250.

While the preferred embodiments are used to describe outlining a batters box, the invention can be used to delineate other playing positions such as but not limited to a pitchers mound, a catchers position, a shortstop position, a fielders position and the like.

Although the preferred embodiment describes using the invention for baseball and softball, the invention can be used to delineate other playing fields for other games such as but not limited to football, volleyball, tetherball and the like.

Although the first and third embodiments describe the straps/flaps having a thickness, t, of approximately 1/16 inches thick to approximately 1 inch, the thickness can vary further. The straps/flaps can have thicknesses greater than one inch (i.e. two inches or greater) and be used as a batters box without using pegs/prongs by burying the lower ground engaging sides similar to the buried pipes in the third embodiment.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A ground engageable portable batters box comprising:

a first longitudinal member having a first end and a second end, an upper surface and a lower surface;

a second longitudinal member having a first and a second end, an upper surface and a lower surface, the second end of the first member perpendicular to and connected to the first end of the second member;

a third longitudinal member having a first and a second end, an upper surface and a lower surface, the second end of the second member perpendicular to and connected to the first end of the third member;

a fourth longitudinal member having a first end and a second end, an upper surface and a lower surface, the second end of the third member perpendicular to and connected to the first end of the fourth member, wherein the first member, the second member, the third member and the fourth member lie in the same plane and form a rectangular batters box, and wherein the lower surfaces of each of the first member, the second member, the third member and the fourth member abut and are substantially flush to a ground surface;

a plastic storage pouch for housing the first longitudinal member, the second longitudinal member, the third longitudinal member, and the fourth longitudinal member; and a strap fixably attached to the storage pouch for attaching and detaching the pouch to a duffel bat bag.

2. The ground engageable portable batters box of claim 1, wherein the first member, the second member, the third member and the fourth member are each formed from:

a substantially flat strap.

3. The ground engageable portable batters box of claim 2, wherein each flat strap includes:

a thickness of approximately 1/16 to approximately 1 inch; and a width of approximately 2 to 4 inches.

4. The ground engageable portable batters box of claim 2, wherein each flat strap is formed from:

rubber.

5. The ground engageable portable batters box of claim 2, wherein each flat strap is formed from:

plastic.

6. The ground engageable portable batters box of claim 2, wherein each flat strap is formed from:

vinyl.

7. The ground engageable portable batters box of claim 2, wherein each flat strap is formed from:

burlap.

8. The ground engageable portable batters box of claim 2, further comprising:

at least four grommets each positioned at a corner of the batters box, each grommet connecting the end of one longitudinal member to an overlapping end of an adjacent longitudinal member, and each grommet having a through-hole between the overlapping longitudinal member ends.

9. The ground engageable portable batters box of claim 8, further comprising:

at least four pegs for insertion into each through-hole of the four grommets.

10. The ground engageable portable batters box of claim 1, further comprising:

heat molding each corner of the batters box, wherein an end of one longitudinal member overlaps a portion of an end of an adjacent longitudinal member, and each overlapping portion has a through-hole therethrough.

11. The ground engageable portable batters box of claim 10, further comprising:

at least four pegs for insertion into each through-hole of each overlapping corner.

12. The ground engageable portable batters box of claim 1, further comprising:

a first side flap having a first end and a second end, the first end attached to the first longitudinal member approximately midway between the first end and the second end of the first longitudinal member, the second end of the first side flap protruding outward away from the first longitudinal member; and a second side flap having a first end and a second end, the first end attached to the third longitudinal member approximately midway between the first end and the second end of the third longitudinal member, the second end of the first side flap protruding outward away from the third longitudinal member.

13. A ground engageable portable batters box comprising:

a first elongated flexible tape having a first end and a second end, an upper surface, a lower surface, and a first tape length;

a second elongated flexible tape having a first and a second end, an upper surface, a lower surface and a second tape length shorter than the first tape length, the second end of the first tape perpendicular to and attached by an overlapping connection to the first end of the second tape;

a third elongated flexible tape having a first and a second end, an upper surface, a lower surface, a third tape length equal to the first tape length, the second end of the second tape perpendicular to and attached by an overlapping connection to the first end of the third tape;

a fourth elongated flexible tape having a first end and a second end, an upper surface, a lower surface and a fourth length equal to the second tape length, the second end of the third tape perpendicular to and attached by an overlapping connection to the first end of the fourth tape, wherein the first tape, the second tape, the third tape and the fourth tape lie in the same plane and form a rectangular batters box, and wherein the lower surfaces of each of the first member, the second member, the third member and the fourth member abut against a ground surface, and wherein the upper surfaces of each of the first member, the second member, the third member and the fourth member are substantially flush to the ground surface.

a first side flap having a first end and a second end, the first end attached to the first tape approximately midway between the first end and the second end of the first tape, the second end of the first side flap protruding outward away from the first tape, wherein a portion of the second end of the first side flap is positioned to abut against a front portion of home plate for right handed batters; and a second side flap having a first end and a second end, the first end attached to the third tape approximately midway between the first end and the second end of the third tape, the second end of the first side flap protruding outward away from the third tape, wherein a portion of the second end of the second side flap is positioned to abut against a front portion of the home plate for left handed batters.

14. The ground engageable portable batters box of claim 13, further comprising:

at least four pegs each for inserting into at least each of the four overlapping corners of the batters box for securing the batters box to the ground.

15. A ground engageable portable batters box comprising:

a first PVC pipe;

a second PVC pipe having the same length as the first PVC pipe;

a third PVC pipe shorter in length than the first and the second PVC pipes;

a fourth PVC pipe having the same length as the third PVC pipe;

four perpendicular bend couplers for coupling each end of the first PVC pipe, the second PVC pipe, the third PVC pipe and the fourth PVC pipe are arranged in a rectangular batters box, wherein at least a portion of the upper sides of the PVC pipes are exposed above ground level while at least all of the lower sides of the cylindrical PVC pipes are buried below the ground level;

a first side pipe stem having a first end and a second end, the first end attached to the first PVC pipe approximately midway between the first end and the second end of the first PVC pipe, the second end of the first side pipe stem protruding outward away from the first PVC pipe; and a second side pipe stem having a first end and a second end, the first end attached to the third PVC pipe approximately midway between the first end and the second end of the third PVC pipe, the second end of the first side pipe stem protruding outward away from the third PVC pipe.

* * * * *